United States Patent [19]

Milcoy

[11] 4,088,829

[45] May 9, 1978

[54] HOUSING FOR ELECTRICAL COMPONENTS

[75] Inventor: Edgar Albert Philip Milcoy, South Milton, near Kingsbridge, England

[73] Assignee: Arrow-Hart (Europe) Limited, Plymouth, England

[21] Appl. No.: 705,575

[22] Filed: Jul. 15, 1976

[51] Int. Cl.[2] ..... H05K 5/00

[52] U.S. Cl. ..... 174/53; 200/297; 361/376; 339/122 R

[58] Field of Search ..... 174/52 R, 53, 58; 248/214, 221.3, 221.4, 223.4; 339/198 GA, 198 G, 198 K, 198 N, 122 R; 361/376, 363, 369, 370; 200/297

[56] References Cited

U.S. PATENT DOCUMENTS

| | | | |
|---|---|---|---|
| 2,681,966 | 6/1954 | Christensen | 200/297 X |
| 3,021,501 | 2/1962 | Blanchet | 339/198 GA |
| 3,236,975 | 2/1966 | De Smidt et al. | 339/198 GA |
| 3,510,830 | 5/1970 | Wieland | 339/198 GA |
| 3,864,511 | 2/1975 | Morby et al. | 174/58 |

*Primary Examiner*—J. V. Truhe
*Assistant Examiner*—David A. Tone
*Attorney, Agent, or Firm*—Davis, Hoxie, Faithfull & Hapgood

[57] ABSTRACT

A housing for the reception of an electrical component, for example an electric switch or relay, comprises a hollow casing of electrically insulating material, for example a parallelepipedic box having a removable or openable lid, a pair of spaced-apart hooking means secured to the inner surface of a wall of the casing, and means serving for the mounting of the casing on a panel or other support. Each of the hooking means may comprise at least one hooking member formed integrally with the wall of the casing, the hook portion of the or each hooking member of each hooking means being directed away from the other hooking means.

2 Claims, 2 Drawing Figures

HOUSING FOR ELECTRICAL COMPONENTS

Figure 1:
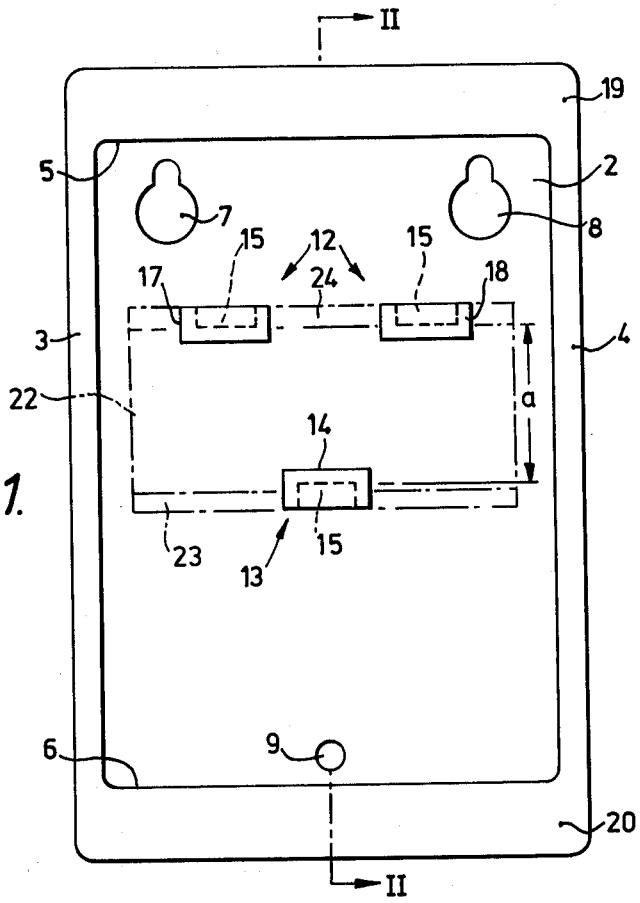

This invention relates to a housing for an electrical component, for example an electrical switch, contactor, latch, tuner or relay.

In my co-pending U.S. Patent application Ser. No. 705,574, filed July 15, 1976, patented Jan. 10, 1978, U.S. Pat. No. 4,067,529. I have described a base member which is attachable to, or forms part of, an electrical component, the base member comprising a plate of synthetic plastics material and a pair of spaced-apart hooking means moulded integrally with the plate and adapted to secure the base member to a support by entering into hooking engagement with a pair of spaced-apart projections on the support, at least one of said hooking means comprising at least one hooking member which is capable of movement towards and away from the other hooking means, said at least one hooking member being urged resiliently towards said other hooking means.

The employment of such base members is particularly advantageous when it is desired to mount a large number of electrical components on a panel or frame. A plurality of said supports each conveniently in the form of an elongate member, for example a rail of shallow channel section having outwardly directed flanges at the free ends of its limbs, are mounted on the panel or frame, and a plurality of the electrical components are mounted on each of the elongate supports in the manner described in my aforesaid application. The entire panel or frame can then be housed in an electrically insulating enclosure and it is not then necessary for each of the individual electrical components to be mounted in its own electrically insulating housing.

When, however, it is desired to mount a single electrical component, or a small number of such components, on a panel or frame it is cheaper to provide the, or each, individual electrical component with its own electrically insulating housing than to enclose the entire panel or frame in an electrically insulating enclosure.

The present invention aims to provide a housing in which an electrical component can be mounted employing one of the base members described in the aforesaid co-pending application.

According to the invention a housing for the reception of an electrical component comprises a hollow casing of electrically insulating material, a pair of spaced-apart hooking means secured to the inner surface of a wall of the casing, and means serving for the mounting of the casing on a panel or other support.

The hollow casing may be in the form of a parallelepipedic box having a removable or openable lid. In this case it is then usually most convenient for said hooking means to be secured to the inner surface of the bottom of the box.

The two spaced-apart hooking means may be provided by a short length of rail of shallow channel section having outwardly directed flanges at the free ends of its limbs, the rail being secured to the casing wall with the web of the section in contact with the wall and the two outwardly directed flanges parallel to, and spaced from, the wall. In this case, the two outwardly directed flanges of the rail constitute the two hooking means of the housing. The rail may be made of metal, for example galvanised mild steel, and may be secured to the casing wall by means of one or more screws, rivets or the like fixing members. A preferred form of such a rail is stamped from mild steel sheet having a thickness of approximately 1 mm, the channel section having a web between 25 and 30 mm wide, side limbs having a height of from 5 to 7 mm, and outwardly directed flanges projecting from 3 to 5 mm from the side limbs.

In an alternative embodiment of the housing in accordance with the invention, said hooking means are formed integrally with said wall of the casing. For example, both the casing and the hooking means may be moulded together from the same synthetic plastics material. In this case, each hooking means comprises at least one hooking member, the hook portion of the, or each, hooking member of each hooking means being directed away from the other hooking means.

The means serving for mounting of the casing on a panel or other support (for example a wall or partition of a building) may consist simply of one or more holes in a wall of the casing through which screws or the like fixing members may be passed.

Figure 2:
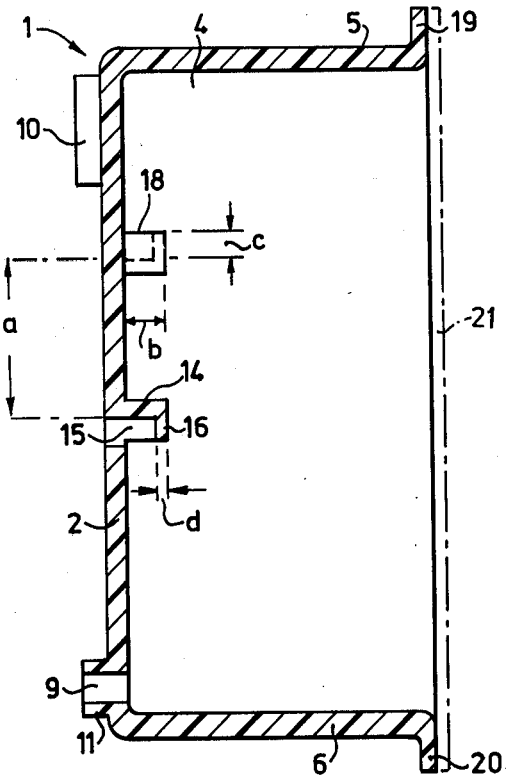

The invention will now be described, by way of example, with reference to the accompanying drawing, in which FIG. 1 is an elevation of one embodiment of a housing in accordance with the invention, and FIG. 2 is a sectional view taken on the line II — II of FIG. 1.

In the drawings, the numeral 1 designates generally a parallelepipedic casing having a bottom 2, side walls, 3, 4 and end walls 5, 6. Holes 7, 8 and 9 are formed through the casing bottom 2, these holes being intended for the reception of screws (not shown) for fixing the casing onto a wall, panel or other support. The casing may be moulded from thermoplastic or thermosetting resin material and the casing bottom may be locally thickened in the regions around the holes 7 - 9, for example by the moulding of bosses 10, 11 on the outwardly facing surface of the bottom 2.

Two hooking means, generally designated by the reference numerals 12 and 13, are secured to the inner surface of the bottom 2. The hooking means 13 consists of a single hooking member 14 moulded integrally with the bottom 2 in the form of a boss of parallelepipedic shape, the face of the boss which is remote from the other hooking means 12 having a recess 15 formed therein, which results in the formation of a hook portion 16 spaced from the inner surface of the bottom 2.

The hooking means 12 consists of two spaced-apart hooking members 17, 18, each of which is of the same construction as the hooking member 14, the recesses 15 of the hooking members 17, 18 being in those faces of the hooking members which are remote from the hooking means 13.

The spacing apart of the hooking means 12 and 13 is chosen to suit the dimensions of the base member (in accordance with the aforesaid application) which it is intended to mount in the casing. It is generally preferred that the dimensions shown in the Figures have the following values:

*a* — from 25 to 30 mm, in particular 27 mm.
*b* — from 5 to 7 mm, in particular 6 mm.
*c* — from 3 to 5 mm, in particular 4 mm.
*d* — approximately 1 mm.

It will be appreciated that the recessed construction of the hooking members 14, 17 and 18 strengthens the hooking portions 16 of the hooking members. It will also be appreciated that the corresponding hooking means of the base member described in the aforesaid application are received in the recesses 15 so that the base member is held securely in the casing 1 and cannot move relative thereto in any direction.

The above described housing would, of course, be provided with a lid (indicated in chain lines in FIG. 2 only and designated with the numeral 21), which may be detachably secured to the flanges 19, 20 of the casing end walls 5, 6.

In an alternative embodiment of the housing shown in FIGS. 1 and 2, the hooking members 14, 17 and 18 are omitted and a short length of the rail of shallow channel section and having outwardly directed flanges at the free ends of its limbs (as described in my aforesaid application) is secured, for example with screws passing through the web of the channel section, to the inner surface of the bottom 2. This rail is shown in chain lines in FIG. 1 only, and is designated by the numeral 22. The outwardly directed flanges 23, 24 of this rail, which are parallel to and spaced from the bottom 2, serve as the pair of spaced-apart hooking means for the reception of an electrical component.

What is claimed is:

1. A casing for the reception of an electrical component, said casing being made of molded electrically insulating material and having at least one pair of opposite walls and a bottom wall, means within the casing for mounting the electrical component comprising a pair of spaced-apart hooking members molded integrally with the inner surface of said bottom wall and facing one of said pair of walls, and another hooking member also molded integrally with said bottom wall but facing the other of said pair of walls, said hooking members having hook portions and side portions which cooperate to hold the electrical component securely, said side portions strengthening said hook portions.

2. A casing for the reception of an electrical component, said casing being made of molded electrically insulating material and having at least one pair of opposite walls and a bottom wall, means within the casing for mounting the electrical component comprising a pair of spaced-apart lugs molded integrally with the inner surface of said bottom wall and having recesses facing one of said pair of walls, and another boss spaced from said pair of bosses and also molded integrally with said bottom wall with a recess facing the other of said pair of walls, said recesses providing said bosses with hook portions and side portions which strengthen said hook portions and providing means to hold said component securely in said casing.

* * * * *